US008342060B2

(12) United States Patent
Chen

(10) Patent No.: US 8,342,060 B2
(45) Date of Patent: Jan. 1, 2013

(54) MULTI-FUNCTION SOCKET WRENCH

(76) Inventor: Chia-Yu Chen, Taichung (TW)

( * ) Notice: Subject to any disclaimer, the term of this patent is extended or adjusted under 35 U.S.C. 154(b) by 219 days.

(21) Appl. No.: 13/011,007

(22) Filed: Jan. 21, 2011

(65) Prior Publication Data

US 2012/0186401 A1 Jul. 26, 2012

(51) Int. Cl.

| | |
|---|---|
| ***B25B 13/06*** | (2006.01) |
| ***B25B 13/00*** | (2006.01) |
| ***B25B 23/16*** | (2006.01) |
| ***B25G 1/04*** | (2006.01) |
| ***B25G 1/00*** | (2006.01) |
| ***B25G 1/02*** | (2006.01) |

(52) U.S. Cl. ..... 81/177.2; 81/121.1; 81/124.5; 81/177.85; 81/177.8; 81/177.5; 81/177.6; 81/177.7

(58) Field of Classification Search ..... 81/177.2, 81/177.85, 177.8, 177.5, 177.6, 177.7
See application file for complete search history.

(56) References Cited

U.S. PATENT DOCUMENTS

| | | | | |
|---|---|---|---|---|
| 6,339,979 | B1 * | 1/2002 | Chiang | 81/177.2 |
| 6,347,564 | B1 * | 2/2002 | Ciocca | 81/177.8 |
| 7,287,450 | B1 * | 10/2007 | Liao | 81/177.9 |
| 2009/0090224 | A1 * | 4/2009 | Lin | 81/177.2 |

* cited by examiner

*Primary Examiner* — Monica Carter
*Assistant Examiner* — Danny Hong
(74) *Attorney, Agent, or Firm* — Ming Chow; Sinorica, LLC

(57) ABSTRACT

A multi-function socket wrench includes a driving head, a handle, a pivot rod, a first elastic limit unit and a second elastic limit unit. The driving head is pivotally connected with the pivot rod. The driving head can be slidably moved on the handle through the pivot rod and the first elastic limit unit. The driving head and the handle are secured through the second elastic limit unit. The handle and the driving head of the multi-function socket wrench can be turned free as the demand of the user to be a T-shaped socket wrench or operated horizontally.

5 Claims, 4 Drawing Sheets

MULTI-FUNCTION SOCKET WRENCH

BACKGROUND OF THE INVENTION

1. Field of the Invention

The present invention relates to a socket wrench, and more particularly to a multi-function socket wrench.

2. Description of the Prior Art

A conventional socket wrench comprises a handle and a tool head. The tool head and the handle are coupled at a specific angle. This kind of socket wrench is used to lock or unlock an object. However, the configuration of the conventional socket wrench is immovable. There are an L-shaped socket wrench and a T-shaped socket wrench on the market. By replacing different sockets, the socket wrench is adapted to lock or unlock different objects. But, the operation and the suitable occasion of these two socket wrenches are different. The user have to carry both the socket wrenches for work. This will be a burden to the user. Accordingly, the inventor of the present invention has devoted himself based on his many years of practical experiences to solve this problem.

SUMMARY OF THE INVENTION

The primary object of the present invention is to provide a multi-function socket wrench which comprises a driving head, a handle, a pivot rod, a first elastic limit unit and a second elastic limit unit. The driving head has two ends defined as a connection part and a pivot part. The connection part is adapted for connection of a socket. The driving head has a notch at the pivot part to form two opposing sides of the pivot part. The two opposing sides have two side walls and a bottom wall connected between the two side walls. The bottom wall has a recess thereon. The two side walls have pivot holes thereon which are coaxial. The handle has a coupling part at one end thereof. The coupling part has an end surface formed with a limit recess. The handle has a limit groove which is axially disposed on one side of the handle. The limit groove extends from the coupling part to a middle portion of the handle. The pivot rod is pivotally connected between the pivot holes of the driving head. The pivot rod has g a through hole at a central portion thereof. The coupling part of the handle is inserted in the through hole. One end of the pivot rod has an insertion hole which is perpendicular to the through hole. The first elastic limit unit is inserted in the insertion hole of the pivot rod. The first elastic limit unit is able to extend in the limit groove of the handle so that the handle can be axially moved on the pivot rod through the limit groove. The second elastic limit unit is inserted in the recess of the driving head. The second elastic limit unit is able to engage with the limit recess.

The driving head is pivotally connected with the pivot rod, so the driving head can use the pivot rod as an axle to slidably move on the handle through the pivot rod. Thus, the multi-function socket wrench of the present invention can be an L-shaped socket wrench or a T-shaped socket wrench or operated horizontally.

DETAILED DESCRIPTION OF THE PREFERRED EMBODIMENTS

Embodiments of the present invention will now be described, by way of example only, with reference to the accompanying drawings.

Figure 1:
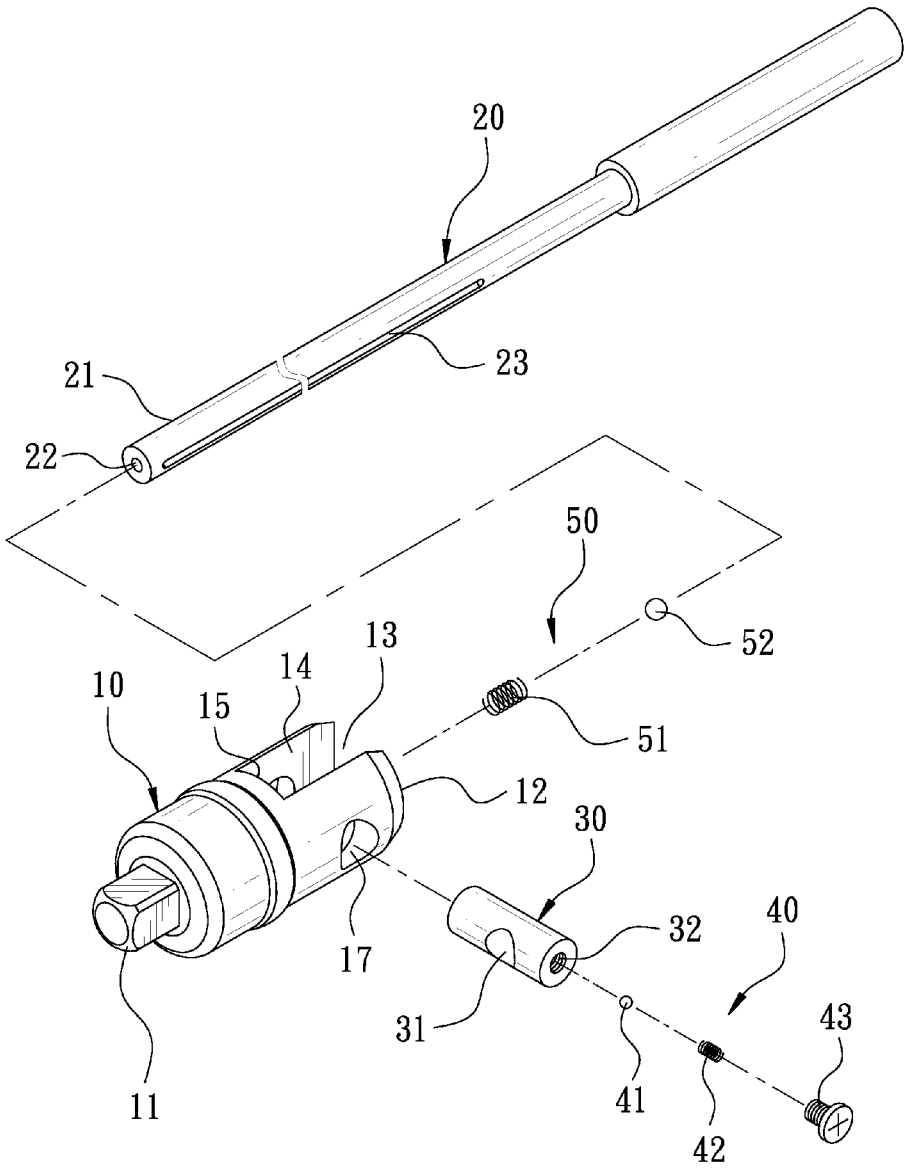
FIG. 1 is an exploded view according to a preferred embodiment of the present invention.
Figure 2:
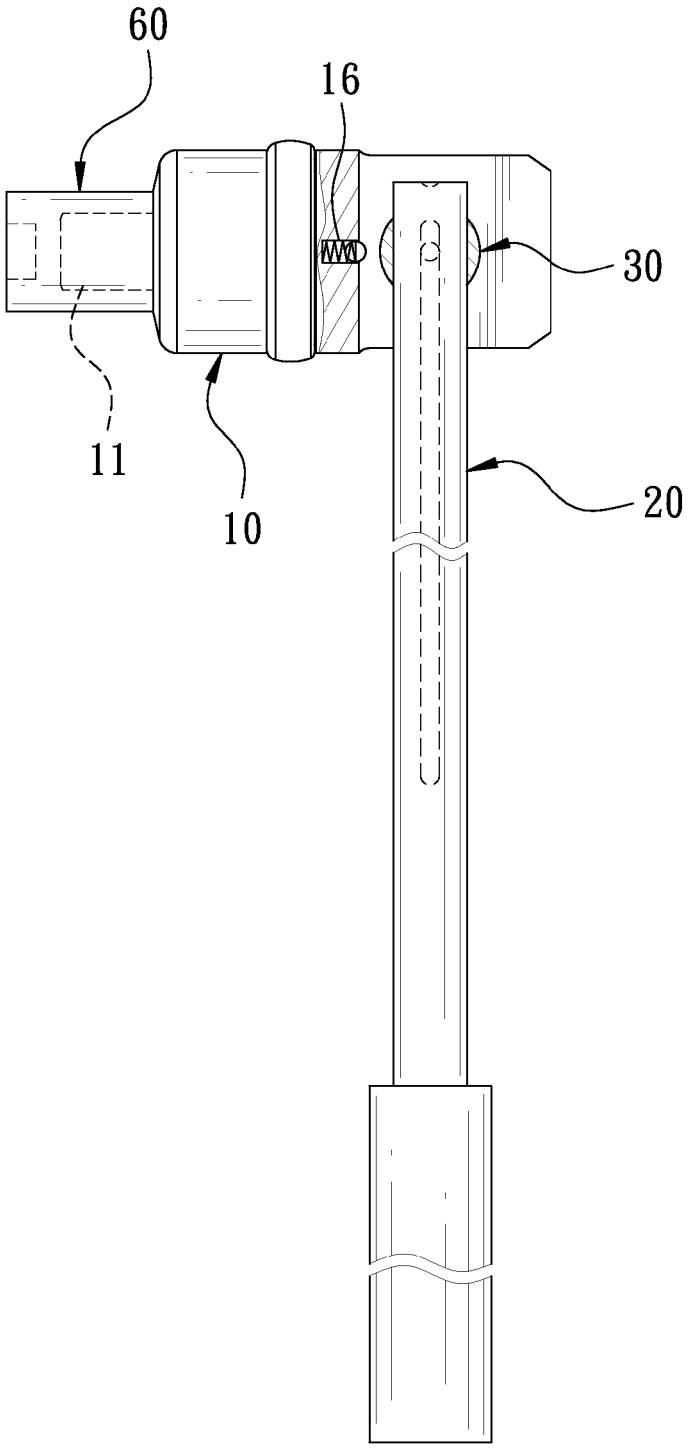
FIG. 2 is a schematic view to show the preferred embodiment of the present invention in an L-shaped state when in use.

As shown in FIG. 1 and FIG. 2, a multi-function socket wrench according to a preferred embodiment of the present invention comprises a driving head 10, a handle 20, a pivot rod 30, a first elastic limit unit 40, and a second elastic limit unit 50.

The driving head 10 has two ends defined as a connection part 11 and a pivot part 12. The connection part 11 is adapted for connection of a socket. The driving head 10 has a notch 13 at the pivot part 12 to form two opposing sides of the pivot part 12. The two opposing sides have two side walls 14 and a bottom wall 15 connected between the two side walls 14. The bottom wall 15 has a recess 16 thereon. The two side walls 14 have pivot holes 17 thereon which are coaxial. In this embodiment, the driving head 10 is a ratchet-type tool head.

The handle 20 has a coupling part 21 at one end thereof. The coupling part 21 has an end surface formed with a limit recess 22. The handle 20 has a limit groove 23 which is axially disposed on one side of the handle 20. The limit groove 23 extends from the coupling part 21 to a middle portion of the handle 20.

The pivot rod 30 is pivotally connected between the pivot holes 17 of the driving head 10, and has a through hole 31 at a central portion thereof. The coupling part 21 of the handle 20 is inserted in the through hole 31. The driving head 10 is movably connected to the handle 20 through the pivot rod 30. One end of the pivot rod 30 has an insertion hole 32 which is perpendicular to the through hole 31. The pivot rod 30 has inner threads on an inner wall of a rear section of the insertion hole 32.

The first elastic limit unit 40 is inserted in the insertion hole 32 of the pivot rod 30. In this embodiment, the first elastic limit unit 40 includes a first steel ball 41, a first spring 42 and a stop member 43 which are placed in the insertion hole 32 in sequence. The first steel ball 41 is exposed out of the insertion hole 32 to extend in the limit groove 23 of the handle 20, and the stop member 43 is screwed in the insertion hole 32 to block the first spring 42. Thus, the handle 20 can be axially moved on the pivot rod 30 through the limit groove 23. In this embodiment, the stop member 43 is a screw.

The second elastic limit unit 50 is inserted in the recess 16 of the driving head 10. In this embodiment, the second elastic limit unit 50 includes a second spring 51 and a second steel ball 52 which are placed in the recess 16 in sequence. The second steel ball 52 is exposed out of the recess 16. When the socket wrench is horizontally operated, the second steel ball 52 will be received in the limit recess 22 to engage with each other.

FIG. 2 is a schematic view to show the preferred embodiment of the present invention in an L-shaped state when in use. Because the driving head 10 is pivotally connected with the pivot rod 30, the driving head 10 can use the pivot rod 30 as an axle. Thus, the handle 20 can be turned 90 degrees with respect to the driving head 10, and then the connection part 11 of the driving head 10 is used to connect a tool socket 60, providing an L-shaped socket wrench function.

Figure 3:
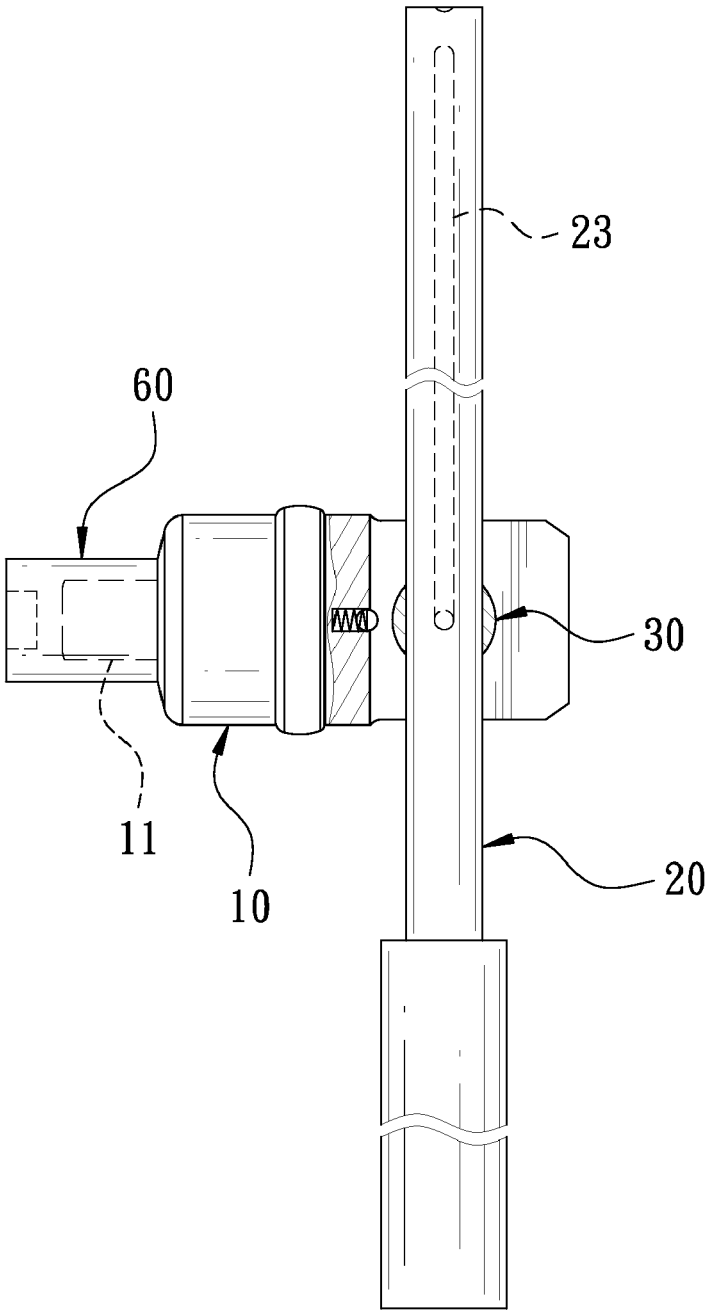
FIG. 3 is a schematic view to show the preferred embodiment of the present invention in a T-shaped state when in use.

FIG. 3 is a schematic view to show the preferred embodiment of the present invention in a T-shaped state when in use. When the handle 20 and the driving head 10 are disposed at 90 degrees, the driving head 10 can be slidably moved along the limit groove 23 through the pivot rod 30 to move the driving head 10 to the middle portion of the handle 20, such that the driving head 10 and the handle 20 are in a T-shaped state. Then, the connection part 11 of the driving head 10 is used to connect the tool socket 60, providing a T-shaped socket wrench function.

Figure 4:
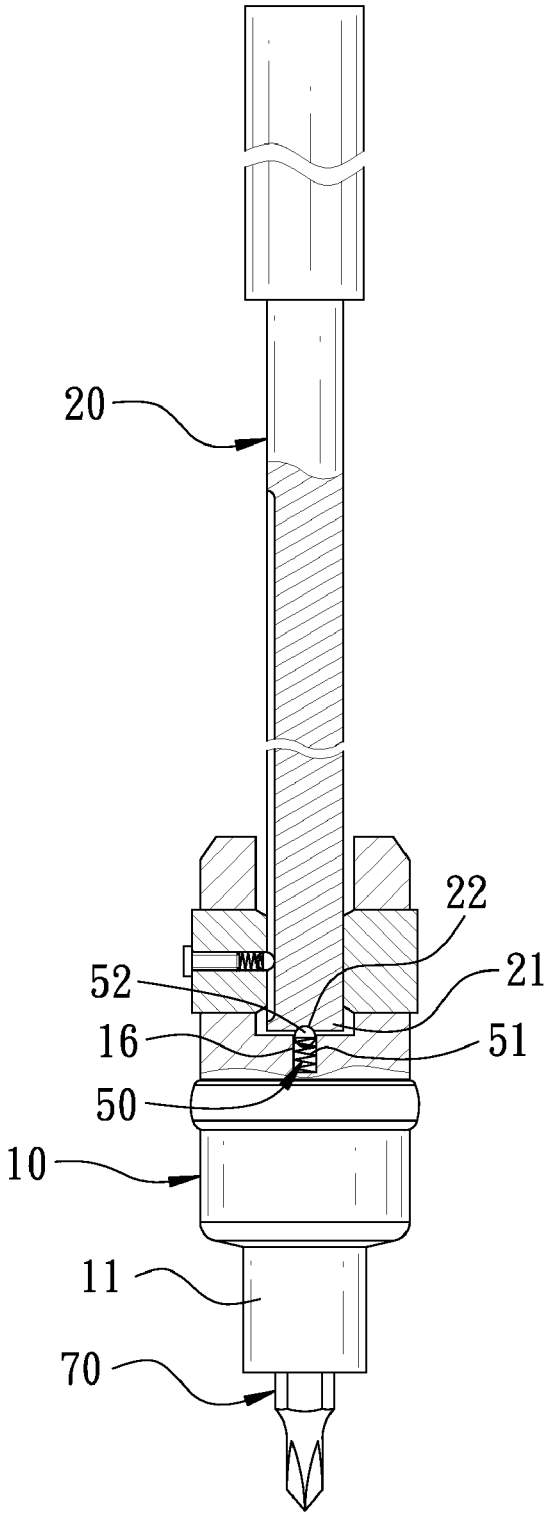
FIG. 4 is a schematic view to show the preferred embodiment of the present invention in a horizontal state when in use.

FIG. 4 is a schematic view to show the preferred embodiment of the present invention in a horizontal state when in use. When the handle 20 and the driving head 10 are horizontally operated, the connection part 11 of the driving head 10 can be used to connect a screwdriver bit 70. The second steel ball 52 of the second elastic limit unit 50 is urged by the second spring 52 to engage with the recess 22 of the handle 20, so that the driving head 10 and the handle 20 are secured and the driving head 10 won't swing easily to provide a screwdriver function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function socket wrench, comprising:

a driving head having two ends defined as a connection part and a pivot part, the connection part being adapted for connection of a socket, the driving head having a notch at the pivot part to form two opposing sides of the pivot part, the two opposing sides having two side walls and a bottom wall connected between the two side walls, the bottom wall having a recess thereon, the two side walls having pivot holes thereon which are coaxial;

a handle having a coupling part at one end thereof, the coupling part having an end surface formed with a limit recess, the handle having a limit groove which is axially disposed on one side of the handle, the limit groove extending from the coupling part to a middle portion of the handle;

a pivot rod pivotally connected between the pivot holes of the driving head, the pivot rod having a through hole at a central portion thereof, the coupling part of the handle being inserted in the through hole, one end of the pivot rod having an insertion hole which is perpendicular to the through hole;

a first elastic limit unit inserted in the insertion hole of the pivot rod, the first elastic limit unit being able to extend in the limit groove of the handle so that the handle is able to axially move on the pivot rod through the limit groove; and a second elastic limit unit inserted in the recess of the driving head, the second elastic limit unit being able to engage with the limit recess.

2. The multi-function socket wrench as claimed in claim 1, wherein the second elastic limit unit includes a spring and a steel ball which are placed in the recess in sequence, and the steel ball is exposed out of the recess to be received in the limit recess of the handle.

3. The multi-function socket wrench as claimed in claim 1, wherein the first elastic limit unit includes a steel ball, a spring and a stop member which are placed in the insertion hole in sequence, the steel ball is exposed out of the insertion hole to extend in the limit groove of the handle, and the stop member is screwed in the insertion hole to block the spring.

4. The multi-function socket wrench as claimed in claim 3, wherein the stop member is a screw, and the pivot rod has inner threads on an inner wall of a rear section of the insertion hole.

5. The multi-function socket wrench as claimed in claim 1, wherein the driving head is a ratchet-type tool head.

* * * * *